US008011816B1

(12) United States Patent
Janda

(10) Patent No.: US 8,011,816 B1
(45) Date of Patent: Sep. 6, 2011

(54) LIGHTED BOTTLE CAP APPARATUS

(76) Inventor: William P. Janda, Birdsboro, PA (US)

( * ) Notice: Subject to any disclaimer, the term of this patent is extended or adjusted under 35 U.S.C. 154(b) by 317 days.

(21) Appl. No.: 12/489,382

(22) Filed: Jun. 22, 2009

Related U.S. Application Data

(60) Provisional application No. 61/192,098, filed on Sep. 15, 2008, provisional application No. 61/132,770, filed on Jun. 23, 2008.

(51) Int. Cl.
*F21V 17/00* (2006.01)

(52) U.S. Cl. ..... 362/375; 362/101; 362/562; 362/800

(58) Field of Classification Search ..... 362/101, 362/562, 375, 800
See application file for complete search history.

(56) References Cited

U.S. PATENT DOCUMENTS

| | | | | |
|---|---|---|---|---|
| 5,178,450 | A | 1/1993 | Zelensky | 362/154 |
| 5,504,663 | A | 4/1996 | Tucker | 362/101 |
| 6,086,216 | A | 7/2000 | Goldfab | 362/101 |
| 6,857,755 | B1 * | 2/2005 | Lewis | 362/104 |
| 7,311,412 | B2 | 12/2007 | Ichikawa | 362/154 |
| 7,470,035 | B1 * | 12/2008 | Benitez | 362/101 |
| 2005/0007773 | A1 * | 1/2005 | Austin | 362/206 |
| 2009/0175029 | A1 * | 7/2009 | Chiang | 362/101 |

* cited by examiner

*Primary Examiner* — Evan Dzierzynski
(74) *Attorney, Agent, or Firm* — Miller Law Group, PLLC

(57) ABSTRACT

A lighted bottle cap apparatus replaces a conventional threaded bottle cap to provide an entertaining light display externally of the bottle and also through the liquid contained within the bottle. The cap apparatus incorporates a battery powered lighting device that utilizes LED's to direct light energy into and away from the bottle. An optional advertising display can be formed as part of the cap apparatus to be illuminated from the lighting device. An alternative embodiment provides a central opening through the cap apparatus to allow the liquid within the bottle to be dispensed therethrough. The lighting device is oriented to direct light energy into the discharged liquid. An adaptor incorporating a translucent panel allows the standard cap apparatus to be connected to multiple bottle configurations. The adaptor has first and second sets of threads separated by the translucent panel to seal the lighting device from the liquid in the bottle.

20 Claims, 6 Drawing Sheets

Fig. 6
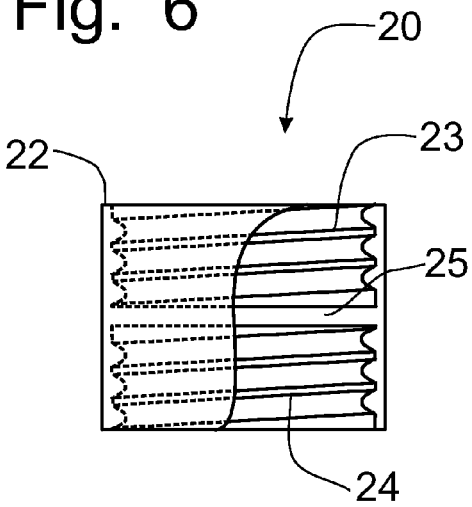
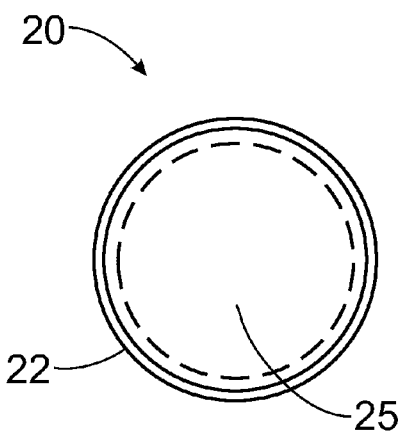
Fig. 7
Fig. 8
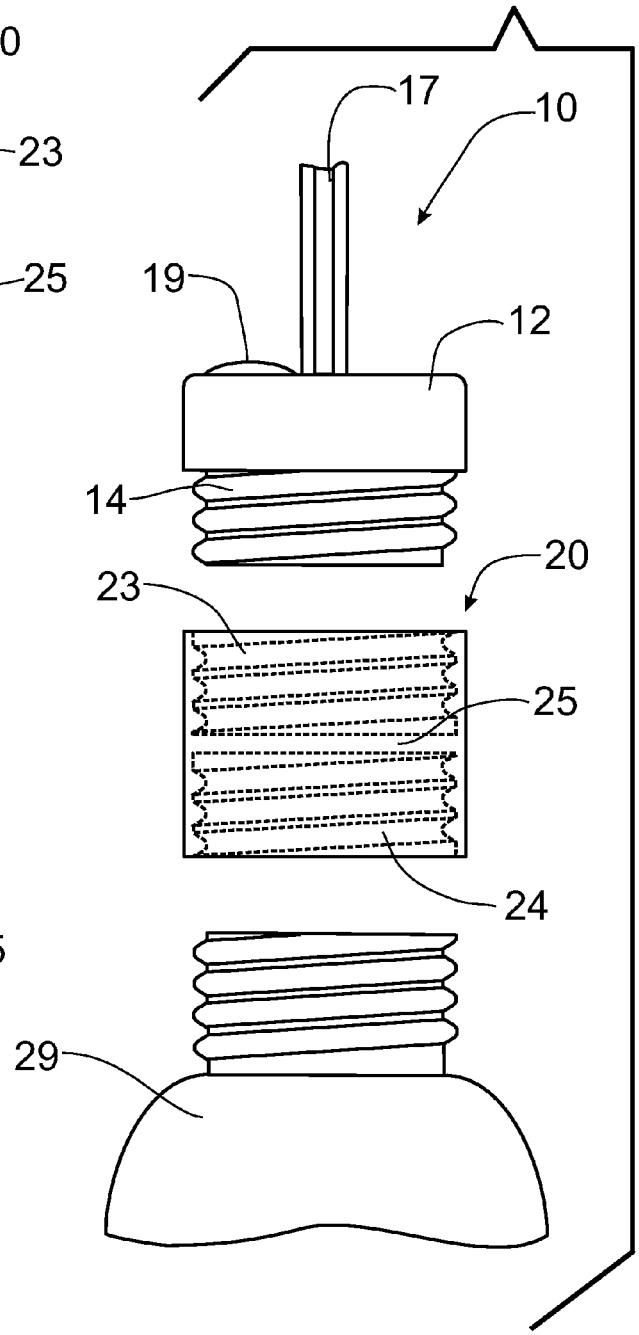

Fig. 9
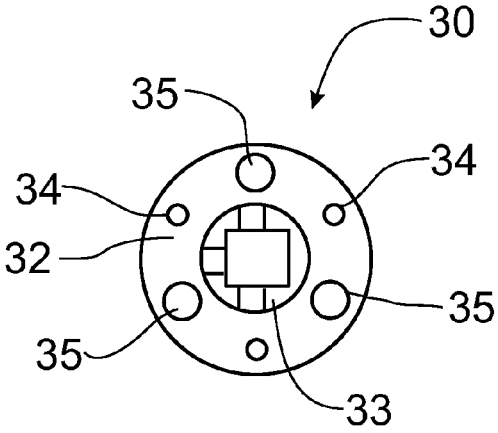
Fig. 10
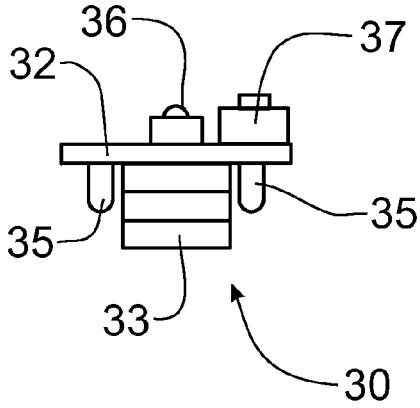
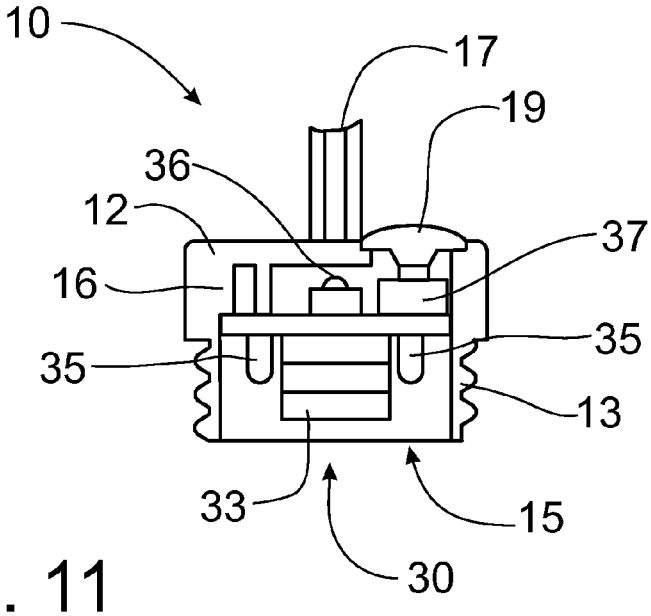
Fig. 11

Fig. 12
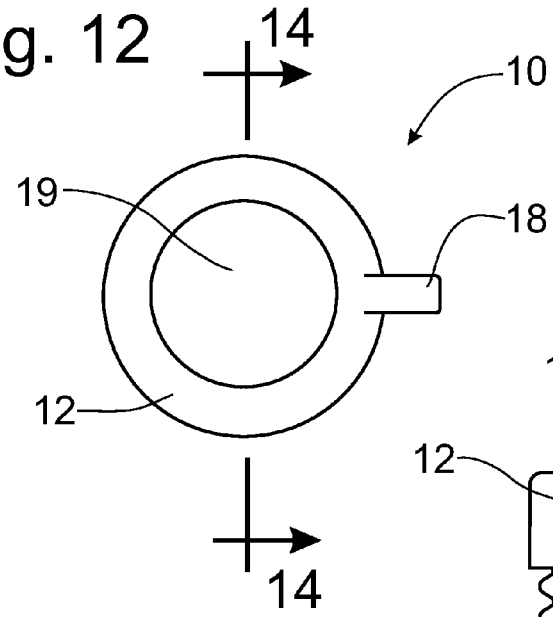
Fig. 13
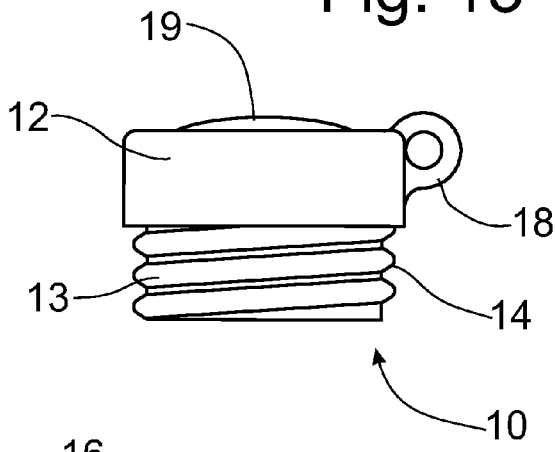
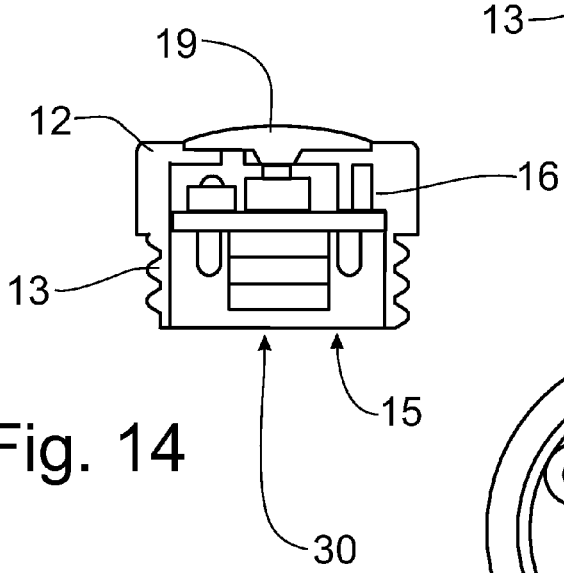
Fig. 14
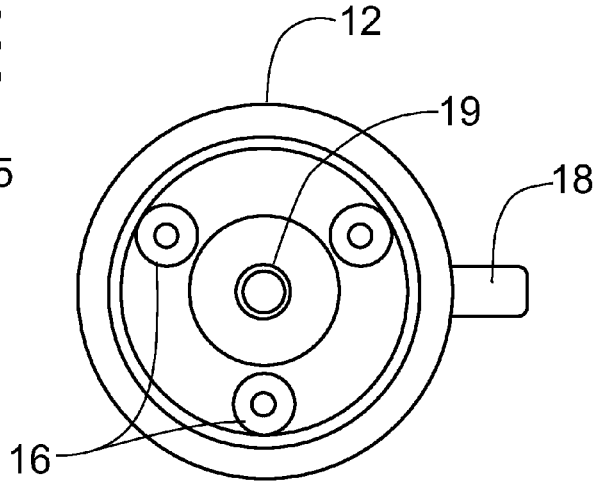
Fig. 15

Fig. 17
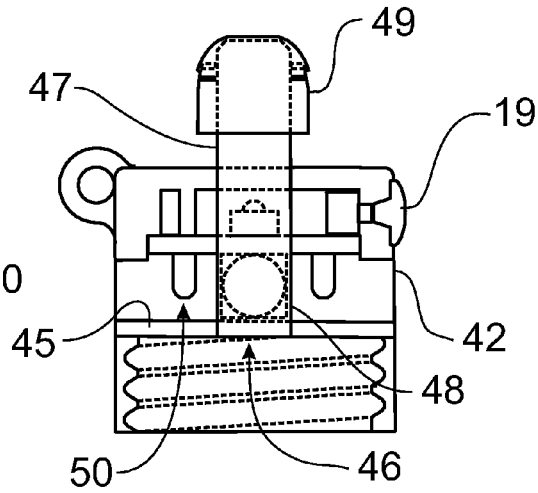
Fig. 16
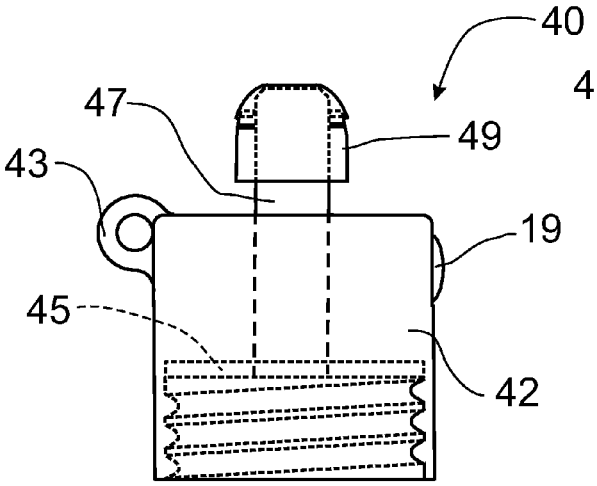
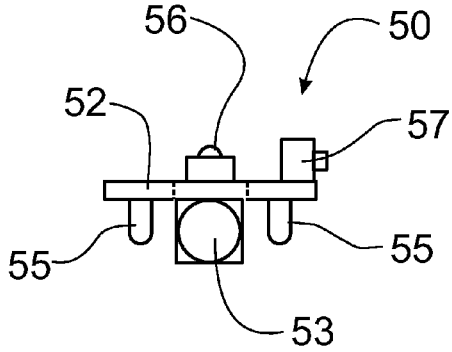
Fig. 18
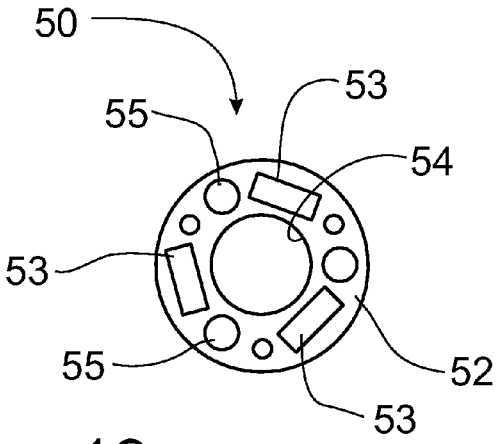
Fig. 19

LIGHTED BOTTLE CAP APPARATUS

CROSS REFERENCE TO RELATED APPLICATIONS

This application claims domestic priority on U.S. Provisional Patent Application Ser. No. 61/132,770, filed on Jun. 23, 2008, and on U.S. Provisional Patent Application Ser. No. 61/192,098, filed on Sep. 15, 2008, the contents of which are incorporated herein by reference.

FIELD OF THE INVENTION

The present invention generally relates to caps for sealing the opening of a bottle containing liquid and, more particularly, to a lighted cap apparatus that provides entertainment by lighting the liquid and the bottle and providing an optional lighted advertisement.

BACKGROUND OF THE INVENTION

Clear plastic bottles are conventionally utilized to package liquid beverages, particularly water, for sale commercially. While the liquid may be clear like water, some beverages are opaque, such as orange juice and cola soft drinks. Sales of bottled liquid beverages are normally provided at entertainment venues, such as entertainment or amusement parks, indoor and outdoor concerts, picnics, fairs and other such situations. The bottled beverage is normally sold with a removable cap sealing the opening to the bottle. Once the bottle has been dispensed, the purchaser normally removes the sealed cap and consumes a portion of the bottled beverage. The cap is usually reinstalled and the partially emptied bottle is carried with the purchaser, but typically, the carrying of the bottle is inconvenient and somewhat awkward as the bottle is too large to fit into most pockets and is often carried by hand.

Lighted entertainment devices, typically novelty items like rope necklaces and hats, are also sold at such entertainment and amusement venues. These lighted entertainment devices are provided with battery operated light emitting diodes (LED's) that flash in brilliant color to entertain and amuse the purchaser. A lighted bottle is disclosed in U.S. Pat. No. 7,311,412, issued on Dec. 25, 2007, to Toshimitsu Ichikawa, wherein the cap is constructed with a battery powered lighting device to shine into the bottle to illuminate the bottle and any liquid carried therein to demonstrated to the purchaser the volume of liquid remaining in the bottle when being carried in the dark.

In U.S. Pat. No. 6,086,216, issued on Jul. 11, 2000, to Eric Goldfab, a light mechanism is constructed to fit on a standard jar opening to convert the jar into a lighted lantern. By utilizing a transparent jar filled, or at least partially filled, with water, the lantern is created by utilizing standard items carried by campers, with the water dispersing the light into the ambient environment. Similarly, a container is adapted for holding a light source in one of multiple possible locations in U.S. Pat. No. 5,504,663, granted to Gale Tucker on Apr. 2, 1996, including a flashlight suspended into the cavity defined by the container for holding liquid therein. An early version of a lighted container for holding liquid is shown in U.S. Pat. No. 5,178,450, granted on Jan. 12, 1993, to Marilyn Zelensky, et al, wherein a light bearing cap is screwed onto the opening of a transparent jar to project light energy into the jar and the liquid therein. The Zelensky patent also discloses the placement of advertisements on the exterior surface or the bottom of the jar to be illuminated with the lighting of the light bulb within the cap apparatus. In each of these lighted bottle arrangements, a lens is provided to keep the liquid in the bottle from contacting the battery powered electrical apparatus providing the light energy into the bottle.

It would be desirable to provide a multi-colored lighting apparatus that can be mounted on substantially any clear plastic, transparent beverage container to provide a novelty item that illuminates the liquid and an external light display that can optionally incorporate an advertisement.

SUMMARY OF THE INVENTION

It is an object of this invention to overcome the disadvantages of the known prior art by providing a multi-colored lighting apparatus for sealing the opening of a beverage bottle after being opened.

It is another object of this invention to provide an entertaining multi-colored lighting display for a beverage bottle that will illuminate the liquid within the bottle as well as the bottle itself.

It is a feature of this invention that the lighting display is retained in a removable cap apparatus that replaces the original cap sealing the bottled beverage.

It is another feature of this invention that the cap apparatus can support a vertically oriented advertisement member that can incorporate a lanyard mount.

It is an advantage of this invention that the multi-colored LED display will project light energy from the cap in multiple directions.

It is still another feature of this invention that the light energy projected into the liquid beverage within the bottle will illuminate the liquid to disperse the light and create a visually pleasing effect.

It is still another object of this invention to provide an adaptor that will enable a standardized lighted cap apparatus to be utilized with substantially any bottle configuration.

It is yet another feature of this invention that the adaptor has a first set of threads corresponding to the cap apparatus and a second set of threads corresponding to a specific bottle configuration with a translucent panel separating the first and second thread sets.

It is still another advantage of this invention that the translucent panel in the adaptor isolates the liquid within the bottle from the cap apparatus.

It is yet another advantage of this invention that the translucent panel allows the passage of light energy from the cap apparatus into the liquid remaining in the bottle container.

It is still another feature of this invention that the adaptor and the cap apparatus can be formed of translucent material or from an opaque material.

It is a further feature of this invention that the cap apparatus incorporates a battery powered lighting device that has at least one LED oriented to direct light energy downwardly through the translucent panel into the bottle container, and at least one LED oriented to direct light energy away from the bottle container.

It is still another advantage of this invention that the LED directing light energy away from the bottle container can be utilized to illuminate an advertising display.

It is another feature of this invention that the light emitting diodes can be configured to have different colors that alternately or randomly flash to provide a pleasing visual effect.

It is yet another object of this invention to provide a lighted cap apparatus that incorporates a central opening for the dispensing of liquid from the interior of the bottle container.

It is another feature of this invention that the lighted cap apparatus incorporates a lighting device that has at least one LED oriented to direct light energy therefrom into the stream of liquid being discharged from the bottle container through the central opening in the cap apparatus.

It is a further advantage of this invention that the cap apparatus includes a closure device associated with the central opening to keep the liquid within the bottle container from being dispensed from the bottle unless selectively opened to allow the dispensing of the liquid.

It is yet another feature of this invention that the cap apparatus includes an asymmetric lanyard mount for the detachable connection of a lanyard thereto.

It is still another advantage of this invention that the utilization of a lanyard enables the bottle to be carried in a hands-free manner.

It is a further feature of this invention that the cap apparatus incorporates a switch that enables the lighting device to be selectively operated.

It is yet another object of this invention to provide a lighted bottle cap apparatus for use with multiple commercial bottle configurations, which is durable in construction, inexpensive of manufacture, carefree of maintenance, and simple and effective in use.

It is still another object of this invention to provide a lighted bottle cap apparatus that provides an entertaining lighting display that is dispersed through the liquid contained within the bottle and to an external display.

These and other objects, features and advantages are accomplished according to the instant invention by providing a lighted bottle cap apparatus that can be utilized to replace a conventional threaded bottle cap to provide an entertaining light display externally from the bottle and also through the liquid contained within the bottle. The cap apparatus incorporates a battery powered lighting device that utilizes LED's to direct light energy into and away from the bottle. An optional advertising display can be formed as part of the cap apparatus to be illuminated from the lighting device. An alternative embodiment provides a central opening through the cap apparatus to allow the liquid within the bottle to be dispensed therethrough. The lighting device is oriented to direct light energy into the discharged liquid. An adaptor incorporating a translucent panel allows a standard cap apparatus to be connected to multiple bottle configurations. The adaptor has first and second sets of threads separated by the translucent panel to seal the lighting device from the liquid in the bottle.

BRIEF DESCRIPTION OF THE DRAWINGS

The advantages of this invention will be apparent upon consideration of the following detailed disclosure of the invention, especially when taken in conjunction with the accompanying drawings wherein:

FIG. 6 is an elevational view of an adaptor incorporating the principles of the instant invention, a portion of the outer wall of the adaptor being broken away to better view the first and second sets of threads separated by the translucent panel;

FIG. 7 is a top plan view of the adaptor shown in FIG. 6;

FIG. 8 is an exploded view of the lighted cap apparatus, the adaptor and the upper portion of a representative bottle on which the adaptor is to be connected, the upper portion of the advertising display being broken away for purposes of clarity;

FIG. 9 is a bottom plan view of the lighting device to be mounted internally of the cap apparatus shown in FIGS. 1-5;

FIG. 10 is an elevational view of the lighting device shown in FIG. 9;

FIG. 11 is an enlarged cross-sectional view similar to that of FIG. 5, but having the lighting device mounted therein;

FIG. 12 is a top plan view of an alternative embodiment of the lighted cap apparatus;

FIG. 13 is an elevational view of the lighted cap apparatus as shown in FIG. 12, oriented to view the lanyard mount to one side of the cap apparatus;

FIG. 14 is a cross-sectional view of the cap apparatus corresponding to lines 14-14 of FIG. 12, the lighting device being removed to permit a better view of the cap structure;

FIG. 15 is a bottom plan view of the cap apparatus shown in FIG. 14;

FIG. 16 is an exploded side elevational view of a second alternative embodiment of a lighted cap apparatus, being formed with a central opening through the base member and the adaptor to form a spout that allows the discharge of liquid from the interior of the bottle;

FIG. 17 is a cross-sectional view of the base member with the lighting device mounted in the interior cavity of the base member;

FIG. 18 is a side elevational view of the lighting device shown in FIG. 17;

FIG. 19 is a bottom plan view of a lighting device to be used in conjunction with the second alternative embodiment of the instant invention depicted in FIG. 16.

DETAILED DESCRIPTION OF THE PREFERRED EMBODIMENT

Figure 1:
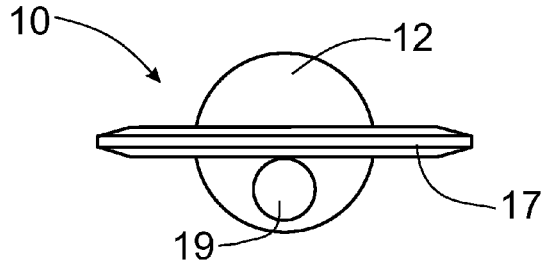
FIG. 1 is a top plan view of a lighted cap apparatus incorporating the principles of the instant invention.
Figure 2:
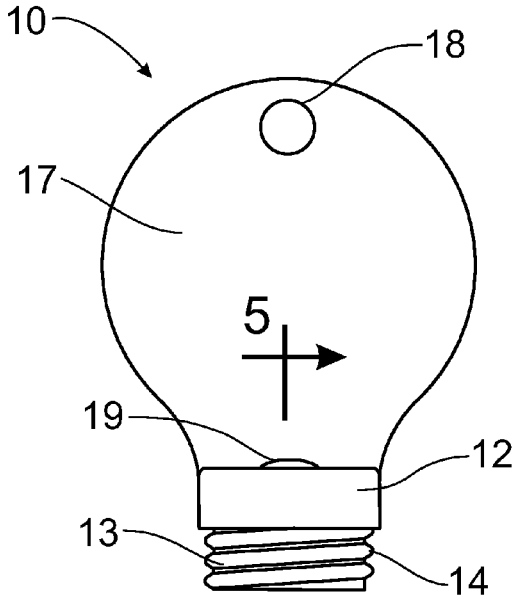
FIG. 2 is a side elevational view of the lighted cap apparatus shown in FIG. 1 with the optional advertising display being oriented to face the viewer.
Figure 3:
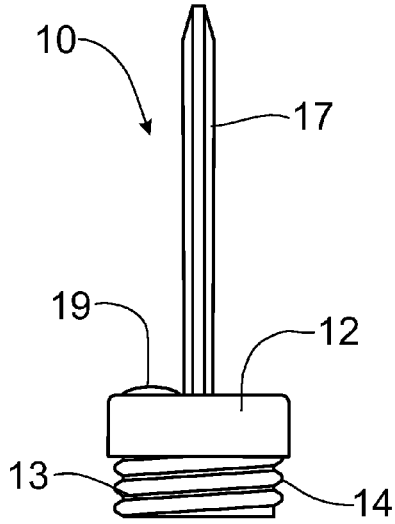
FIG. 3 is a side plan view of the lighted cap display oriented orthogonally to the side elevational view of FIG. 2.
Figure 4:
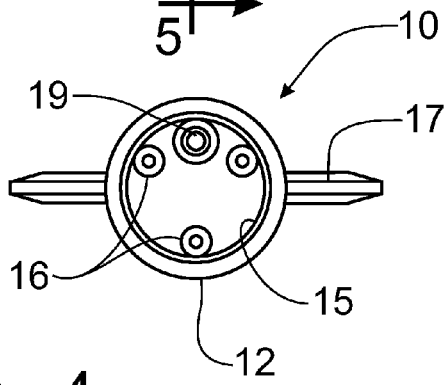
FIG. 4 is a bottom plan view of the cap apparatus with the lighting device removed to facilitate the viewing of the cap structure.
Figure 5:
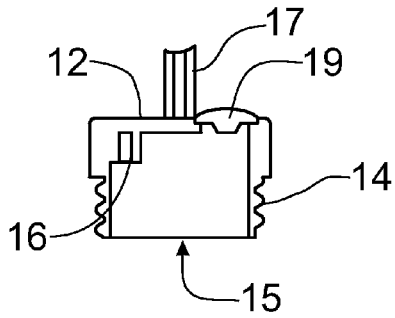
FIG. 5 is a cross-sectional view of the cap apparatus corresponding to lines 5-5 of FIG. 2, with the lighting device removed to facilitate the viewing of the cap structure, the upper portion of the advertising display being broken away for purposes of clarity.
Figure 20:
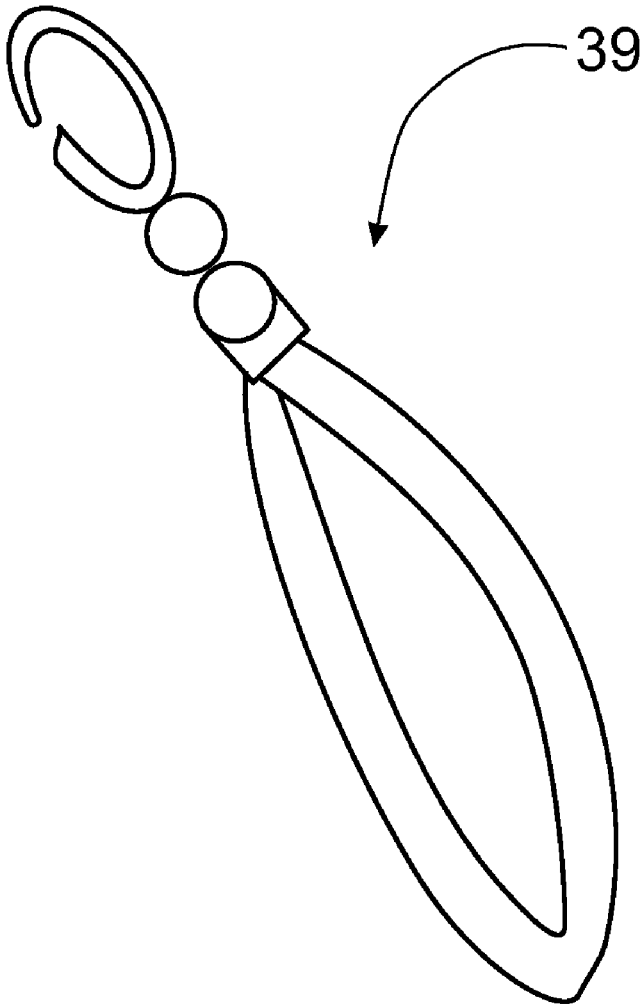
FIG. 20 is a perspective view of a representative lanyard that is connectable to the lanyard mounting structure provided on the cap apparatus.

Referring to FIGS. 1-5, a lighted cap apparatus incorporating the principals of the instant invention can best be seen. The cap apparatus 10 is intended to replace the removable cap placed on commercially available bottled beverages, particularly bottled water, but can be used with any clear or opaque liquid beverage. The cap apparatus 10 is formed with a base member 12 having downwardly extending portion 13 formed with a set of male threads 14. As is best seen in FIGS. 4 and 5, the base member 12 defines a hollow cavity 15 into which an electronic, battery powered lighting device 30 is mounted, as will be described in greater detail below. The cavity 15 is provided with mounting bosses 16 to secure the lighting device 30 thereto.

The top of the base member 12 has a centrally disposed advertising display member 17 that can be formed in any predetermined shape, but is preferably constructed from a translucent polymer to facilitate the transmission of light energy therethrough and is preferably formed with an opening at the top to establish a lanyard connection mount 18. The advertising display member 17 can be etched or molded with an advertising logo. The advertising display member 17 is preferably secured to the top of the base member 12 so that an activation switch 19 can be positioned to one side of the advertising display member 17. The activation switch 19 can be a depressible button, which may be covered with a soft plastic shell to make the switch 19 watertight, or the activation switch could be a motion activated switch.

Referring now to FIGS. 6-8, an adaptor 20 cooperable with the cap apparatus 10 can best be seen. The adaptor 20 is preferably formed with a cylindrical outer housing 22 with a first set of female threads 23 at one end thereof and a second set of female threads 24 at the opposing end of the outer housing 22. A translucent central panel 25 separates the first and second sets of threads 23, 24. The first set of threads 23 is formed to be compatible with the male threads 14 on the downwardly depending portion 13 of the base member 12 so that the base member 12 can be mounted onto the one end of the adaptor 20. The opposing end of the adaptor 20 has the second set of threads 24 configured to mate with a selected commercially available plastic beverage bottle 29. A different adaptor 20 would be required for each bottle configuration such that the second set of threads 24 would be matched to a specific bottle configuration, though the first set of threads 23 would be standardized to mate with the male threads 14.

By securing the base member 12 to the adaptor 20, the lighting device 30 would be isolated from the liquid within the interior of the bottle 29 by the translucent panel 25, which allows the passage of light energy from the lighting device 30 into the interior of the bottle 29, and into any liquid remaining therein. The liquid, particularly if the liquid is clear, such as water, will disperse the light energy passing through the translucent panel 25 and create an enjoyable lighting display therein. Typically, the base member 12 will be tightly secured to the one end of the adaptor 20 containing the first set of threads 23 and form an integrated assembly that is removed as desired from the bottle 29 to permit the liquid beverage therein to be consumed.

Referring now to FIGS. 9-11, the lighting device 30 includes a printed circuit board 32 operably connected to a battery pack 33 to obtain electrical power therefrom. The printed circuit board 32 is also connected to the activation switch 19 by a control circuit 37 to control the flow of electrical current from the battery pack 33 through the circuit 32. The battery pack 33 can be formed from one or more watch batteries, which can be formed to be replaceable or be integrally contained within the lighting device 30 to not be replaceable. Holes 34 are formed in the printed circuit board 32 to allow the passage of fasteners to engage aligned mounting bosses 16 and secure the lighting device 30 within the cavity 15 of the base member 12. The printed circuit board 32 further has a plurality of light emitting diodes (LED) 35, 36 connected to the circuit 32 to illuminate when electrical current is directed thereto. The control circuit 37 can be configured to provide a plurality of lighting sequences from simply turning the light on to provide a constant illumination to a number of flashing patterns and sequences.

Preferably, at least two of the LED's 35 are oriented to direct light energy into the interior of the bottle 29 to illuminate the bottle 29 and any liquid present within the bottle 29. Also, the preferable configuration of the lighting device 30 would have at least one LED 36 oriented to direct light energy upwardly into the advertising display member 17. The illumination of the LED's 35, 36 will also illuminate the base member 12 and the adaptor 20 in the selected lighting pattern. One skilled in the art will recognize that a random flashing pattern for the LED's 35, 36 can provide an aesthetically pleasing visual display for the cap apparatus 10, but also of the liquid in the bottle 29 and further to the advertising display member 17 to direct attention to the advertisement placed thereon. Making the respective LED's 35, 36 different colors will enhance the pleasing visual effect.

In operation, the cap apparatus 10 is placed on the screw top of an opened bottle 29 containing a liquid beverage, such as water, with the second set of threads 24 of the adaptor 20 being engaged with the bottle 29. The base member 12 is mounted to the first set of threads 23 of the adaptor 20 to form an assembly having the lighting device 30 mounted in the cavity 15 and sealed from the liquid in the bottle 29 by the transverse translucent panel 25. Once mounted on the opened bottle 29, the operator depresses the activation switch 19 to initiate the lighting sequence selected for this particular lighting device 30. The LED's 35 direct light energy into the bottle 29 to illuminate both the bottle 29 and the liquid remaining therein. The upwardly directed LED's 36 illuminate the advertising display member 17, if provided, to direct attention to the advertising placed thereon. If no advertising display member 17 is provided, the upwardly directed LED 36 will simply illuminate the base member 12. If a lanyard 39, such as depicted in FIG. 19, is connected to the lanyard connection mount 18 provided, for example, at the top of the advertising display member 17, the bottle 29 can be carried around the purchaser's neck for convenient no-hands transport of the beverage.

An alternative configuration for the cap apparatus 10 is depicted in FIGS. 12-15, wherein no vertically oriented advertising display member 17 is provided. Using like reference numbers to the elements described above with respect to the first embodiment, the cap apparatus 10 includes a base member 12 having a downwardly extending portion 13 formed with a set of male threads 14 configured to be engagable with the first set female threads 23 on the adaptor 20. For aesthetics purposes, the activation switch 19 can be enlarged, as shown in FIGS. 12-14, to present a large centrally located button at the top of the base member 12. The base member 12 can also be formed with an integral lanyard mount 18 capable of supporting the weight of a bottle 29 filled with a liquid beverage. The lighting device 30 is essentially the same as that shown in FIGS. 9-11, except that the control circuit can be centrally positioned to mate with the activation switch 19 and the upwardly directed LED's 36 can be positioned off center, as is reflected in FIG. 14.

Another alternative configuration of the instant invention is shown in FIGS. 16-19. The primary difference in this second alternative configuration is that the cap apparatus 40 includes a central passage 46 for the dispensing of the liquid beverage from within the bottle 29 without requiring the cap apparatus 40 to be removed from the bottle 29. As with conventional sports beverage bottles, the central passage 46 extends upwardly from the base member 42 to form a spout 47 that is topped by a closure device 49 which can be a pop-up nozzle as depicted generally in FIG. 16, or other known closures such as a flip-top member (not-shown) or a removable threaded cap that is taken from the top of the purchased bottle 29, etc.

The base member 42 is preferably formed with the female threads for connection to the top of the purchased beverage bottle 29 and has the central passage 46 extending through the base member 42 to terminate as the spout 47. To isolate the liquid beverage from the lighting device 50, the base member 42 includes a translucent panel 45 which is located at the interior end of the female threads. The central passage defines an interior chamber wall 48 passing through the base member 42 where the lighting device 50 is located. The base member can be formed with a removable outer shell that will permit the lighting device to be installed while maintaining the integrity of the central passage 46 so as to isolate the interior cavity of the base member 42. This removable outer shell can be detachable or secured, such as by adhesives, in which case the batteries 53 would not be replaceable.

Similarly, as is depicted in FIGS. 18 and 19, the lighting device 50 includes a printed circuit board 52 that is operatively connected to batteries 53 positioned around the central opening 54 in the printed circuit board 52. The printed circuit board 52 is controlled through a control circuit 57 connected to the activation switch 19, as is described above with respect to FIGS. 1-11. The lighting device 50, however, is formed with a central opening 54 to permit passage of the interior chamber wall 48. Accordingly, the batteries 53, the LED's 55, 56, and the activation switch 19 must be offset from the center of the printed circuit board 52. Although the specific position of the downwardly directed LED 55 is not intended to be defined in FIGS. 18 and 19, the relative orientation is the same as described above to illuminate the bottle 29 and the liquid contained therein. The upwardly directed LED's 56, however, are preferably oriented to illuminate the liquid as the liquid is being dispensed through the spout 47. Accordingly, the operation of the cap apparatus 50 will not only illuminate the bottle 29 and the liquid contained therein, as described in detail above, but also illuminate the stream of the liquid being discharged from the spout 47.

All of the components described above for the base members 12, 42 and the adaptors 20, 45 are preferably formed from plastic that can be either translucent or opaque, except for the transverse panel 25 which needs to be translucent for the effective passage of light energy from the downwardly direct LED's 55. These plastic components are effectively formed via injection molding techniques and assembled as needed. One skilled in the art will recognize that the specific preferred configuration of the sports bottle cap apparatus, depicted in FIGS. 16-19, can be constructed in other similar configurations, such as by having a base member and an adaptor formed with the central passage extending therethrough to provide a similar structure to the first embodiment shown in FIGS. 1-11.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiments of the invention; however, concepts, as based upon the description, may be employed in other embodiments without departing from the scope of the invention.

Having thus described the invention, what is claimed is:

1. A cap apparatus for sealing an opening of a beverage bottle comprising:

a base member having a top portion and a downwardly depending portion formed with male threads, said base member defining an interior cavity opening downwardly through said downwardly depending portion, said base member supporting an activation switch;

a lighting device mounted to said base member within said interior cavity, said lighting device having a control circuit operably connected to said activation switch and to a battery pack providing a source of electrical current, said lighting device including at least one downwardly oriented light emitting diode positioned to direct light energy therefrom into said beverage bottle and at least one upwardly oriented light emitting diode to direct light energy therefrom into said base member; and an adaptor member having a first set of female threads cooperable with said male threads on said base member and a second set of female threads adapted to be engaged with said beverage bottle, said first and second sets of female threads being separated by a transverse translucent panel.

2. The cap apparatus of claim 1 wherein said base member and said adaptor are formed of plastic.

3. The cap apparatus of claim 2 further comprising a vertically oriented advertising display member mounted to said top portion of said base member and projecting upwardly therefrom.

4. The cap apparatus of claim 3 wherein said advertising display member is translucent and is operably coupled to said base member to receive light energy emitted from said at least one upwardly oriented light emitting diode to cause illumination of said advertising display member.

5. The cap apparatus of claim 4 wherein said advertising display member includes a lanyard mount for the connection of a removable lanyard thereto.

6. The cap apparatus of claim 5 wherein said lighting apparatus is operable to illuminate said light emitting diodes in a plurality of patterns and sequences.

7. The cap apparatus of claim 2 wherein said base member and said adaptor are formed with a central opening therethrough to define a spout for the dispensing of liquid from within said beverage bottle.

8. The cap apparatus of claim 7 wherein said upwardly oriented light emitting diodes are operable to direct light energy therefrom into said spout to illuminate liquid being dispensed from said spout.

9. The cap apparatus of claim 8 wherein said base member is formed with a lanyard mount.

10. A cap apparatus for sealing an opening of a beverage bottle comprising:

a base member having a top portion and a downwardly depending portion formed with threads, said base member defining an interior cavity and supporting an activation switch;

a lighting device mounted to said base member within said interior cavity, said lighting device having a control circuit operably connected to said activation switch and to a battery pack providing a source of electrical current, said lighting device including at least one downwardly oriented light emitting diode positioned to direct light energy therefrom into said beverage bottle and at least one upwardly oriented light emitting diode to direct light energy therefrom into said base member; and a vertically oriented translucent advertising display member mounted to said top portion of said base member and projecting upwardly therefrom to receive light energy emitted from said at least one upwardly oriented light emitting diode to cause illumination of said advertising display member.

11. The cap apparatus of claim 10 wherein said advertising display member includes a lanyard mount for the connection of a removable lanyard thereto.

12. The cap apparatus of claim 10 wherein said lighting apparatus is operable to illuminate said light emitting diodes in a plurality of patterns and sequences.

13. The cap apparatus of claim 12 further comprising an adaptor member having a first set of female threads cooperable with said threads on said base member and a second set of female threads adapted to be engaged with said beverage bottle, said first and second sets of female threads being separated by a transverse translucent panel.

14. The cap apparatus of claim 12 wherein said advertising display panel has an advertisement formed into said advertising display panel to be illuminated by said at least one upwardly oriented light emitting diode.

15. A cap apparatus for sealing an opening of a beverage bottle comprising:

a base member having a top portion and a downwardly depending portion formed with threads, said base member defining an interior cavity, said base member supporting an activation switch;

a lighting device mounted to said base member within said interior cavity, said lighting device having a control circuit operably connected to said activation switch and to a battery pack providing a source of electrical current, said lighting device including at least one downwardly oriented light emitting diode positioned to direct light energy therefrom into said beverage bottle and at least one upwardly oriented light emitting diode to direct light energy therefrom into said base member; and a spout extending through a central opening in said base member to provide a passage for the dispensing of liquid from within said bottle through said base member, said at least one upwardly oriented light emitting diode illuminating said spout and liquid being discharged through said spout.

16. The cap apparatus of claim 15 wherein said base member is formed with a lanyard mount.

17. The cap apparatus of claim 15 wherein said lighting apparatus is operable to illuminate said light emitting diodes in a plurality of patterns and sequences.

18. The cap apparatus of claim 17 wherein said spout is provided with a closure member to seal said spout from the discharge of liquid therethrough.

19. The cap apparatus of claim 18 further comprising an adaptor member having a first set of female threads cooperable with said threads on said base member and a second set of female threads adapted to be engaged with said beverage bottle, said first and second sets of female threads being separated by a transverse translucent panel, said adaptor having a central opening therein for the passage of said spout to be in flow communication with liquid within said bottle.

20. The cap apparatus of claim 19 wherein said spout is integrally formed in said base member and sealed against said adaptor.

* * * * *